United States Patent [19]

Whitney

[11] Patent Number: 4,638,150

[45] Date of Patent: Jan. 20, 1987

[54] MODULAR ELECTRICAL HEATER

[75] Inventor: Wells Whitney, Menlo Park, Calif.

[73] Assignee: Raychem Corporation, Menlo Park, Calif.

[21] Appl. No.: 632,776

[22] Filed: Jul. 19, 1984

[51] Int. Cl.[4] ..... H05B 3/16

[52] U.S. Cl. ..... 219/543; 219/505; 219/549; 219/553; 338/22 R

[58] Field of Search ..... 219/505, 508, 528, 541, 219/543, 544, 548, 549, 553; 338/22 R, 22 SD, 195, 214, 295, 314; 174/52 PE

[56] References Cited

U.S. PATENT DOCUMENTS

| | | | |
|---|---|---|---|
| 3,757,086 | 9/1973 | Indoe | 219/528 |
| 3,976,854 | 8/1976 | Ishikawa et al. | 219/505 |
| 4,072,848 | 2/1978 | Johnson et al. | 219/528 |
| 4,100,673 | 7/1978 | Leavines | 338/295 X |
| 4,104,509 | 8/1978 | Van Bokestal et al. | 219/544 |
| 4,117,312 | 9/1978 | Johnson et al. | 219/548 |
| 4,147,927 | 4/1979 | Pirotte | 219/541 |
| 4,151,401 | 4/1979 | Van Bokestal et al. | 219/508 |
| 4,210,800 | 7/1980 | Van Bokestal et al. | 219/544 |
| 4,246,468 | 1/1981 | Horsma | 219/553 |
| 4,250,400 | 2/1981 | Lee | 219/549 |
| 4,449,039 | 5/1984 | Fukazawa et al. | 219/553 |
| 4,485,297 | 11/1984 | Grise et al. | 219/528 |

*Primary Examiner*—C. L. Albritton

*Attorney, Agent, or Firm*—Timothy H. P. Richardson; Herbert G. Burkard

[57] ABSTRACT

A heater comprising a pair of flexible elongate parallel conductors which are connectable to a power supply, and a plurality of rigid heating modules connected in parallel with each other between the conductors. Each of the heating modules comprises a resistive heating component which has been deposited on the substrate and which generates heat when the conductors are connected to a suitable power supply. The heating component may have a positive temperature coefficient of resistance or substantially zero temperature coefficient of resistance.

20 Claims, 11 Drawing Figures

TOP

BOTTOM

TOP

BOTTOM

TOP

BOTTOM

MODULAR ELECTRICAL HEATER

FIELD OF THE INVENTION

This invention relates to electrical strip heaters.

INTRODUCTION TO THE INVENTION

Many elongate electrical heaters, e.g. for heating pipes, tanks and other apparatus in the chemical process industry, comprise two (or more) relatively low resistance conductors which are connected to the power source and run the length of the heater, with a plurality of heating elements connected in parallel with each other between the conductors (also referred to in the art as electrodes.) In conventional conductive polymer strip heaters, the heating elements are in the form of a continuous strip of conductive polymer in which the conductors are embedded. In other conventional heaters, known as zone heaters, the heating elements are one or more resistive metallic heating wires. In zone heaters, the heating wires are wrapped around the conductors, which are insulated except at spaced-apart points where they are connected to the heating wires. The heating wires contact the conductors alternately and make multiple wraps around the conductors between the connection points. For many uses, elongate heaters are preferably self-regulating. This is achieved, in conventional conductive polymer heaters, by using a continuous strip of conductive polymer which exhibits PTC behavior. It has also been proposed to make zone heaters self-regulating by connecting the heating wire(s) to one or both of the conductors through a connecting element composed of a ceramic PTC material.

Elongate heaters of various kinds, and conductive polymers for use in such heaters, are disclosed in U.S. Pat. Nos. 2,952,761, 2,978,665, 3,243,753, 3,351,882, 3,571,777, 3,757,086, 3,793,716, 3,823,217, 3,858,144, 3,861,029, 3,950,604, 4,017,715, 4,072,848, 4,085,286, 4,117,312, 4,177,376, 4,177,446, 4,188,276, 4,237,441, 4,242,573, 4,246,468, 4,250,400, 4,252,692, 4,255,698, 4,271,350, 4,272,471, 4,304,987, 4,309,596 4,309,597 4,314,230, 4,315,237 4,317,027, 4,318,881, 4,330,704, 4,334,351, 4,352,083, 4,388,607, 4,398,084, 4,413,301, 4,426,339, 4,574,188 and 4,582,983. The disclosure of each of the patents, publications and applications referred to above is incorporated herein by reference.

SUMMARY OF THE INVENTION

I have now discovered that substantial improvements and advantages can be provided in the performance and application of elongate electrical heaters comprising a pair of flexible elongate parallel conductors which are connectable to a power supply, by providing a plurality of rigid heating modules connected in parallel with each other between the conductors, the physical and electrical connections between the modules and the elongate conductors being provided by electrical leads, and each of the heating modules comprising (a) a rigid insulating substrate and (b) a resistive heating component which has been deposited on the substrate and which generates heat when the conductors are connected to a suitable power supply.

An important feature of the present invention is the use of leads, preferably wires, to connect the modules to the elongate conductors; if the modules are in direct physical contact with the conductors the differences in thermal expansion coefficients of the materials, and the lack of flexibility, cause serious problems. The leads should of course be flexible by comparison with the substrate. Preferably the heater is sufficiently flexible to be wrapped several times around a pipe having a diameter of 0.5 inch, without damage to the heater.

The heater may have a power output which is substantially independent of temperature, the heating components having a substantially zero temperature coefficient of resistance. However, the heater preferably comprises a temperature-responsive component which is thermally coupled to the heating component and which has an electrical property which varies so that, when the heater is connected to the power supply, the heat generated by the module decreases substantially as the temperature of the module approaches an elevated temperature. The heating component and the temperature-responsive component may both be provided by a single component which has a positive temperature coefficient of resistance or alternatively, the heating component can have a substantially zero temperature coefficient of resistance and the temperature-responsive component can be a separate component which has a positive temperature coefficient of resistance.

In this specification, a material is defined as having a "positive temperature coefficient of resistance" if it increases in resistivity, in the temperature range of operation, sufficiently to render the heater self-regulating; preferably the material has an $R_{14}$ value of at least 2.5 or an $R_{100}$ value of at least 10, and preferably an $R_{30}$ value of at least 6, where $R_{14}$ is the ratio of the resistivities at the end and beginning of the 14° C. range showing the sharpest increase in resistivity; $R_{100}$ is the ratio of the resistivities at the end and beginning of the 100° C. range showing the sharpest increase in resistivity; and $R_{30}$ is the ratio of the resistivities at the end and beginning of the 30° C. range showing the sharpest increase in resistivity. A material is defined as a ZTC material if it is not a PTC material in the temperature range of operation.

In another aspect of the invention there is provided a module which is suitable for use in the manufacture of a self-limiting heater and which comprises (a) a rigid insulating substrate;

(b) a zero temperature coefficient of resistance heating component which has been deposited on the substrate;

(c) a separate positive temperature coefficient of resistance component secured to the substrate; and (d) a series electrical connection between the zero temperature coefficient of resistance component and the positive temperature coefficient of resistance component.

In another aspect of the invention there is provided a method of making a self-limiting heater comprising (1) providing a plurality of heating modules, each of which comprises (a) a rigid insulating substrate;

(b) a resistive heating component which has been deposited on the substrate and which generates heat when connected to a suitable power supply; and (c) a temperature-responsive component which is thermally coupled to the heating component and which has an electrical property which varies so that, when the heater is connected to a power supply, the heat generated by the module decreases substantially as the temperature of the module approaches an elevated temperature; and (2) connecting each of said heating modules between a pair of flexible elongate parallel conductors by means of electrical leads.

BRIEF DESCRIPTION OF THE DRAWINGS

The invention is illustrated in the accompanying drawings in which.

DETAILED DESCRIPTION OF THE INVENTION

Figure 1A:
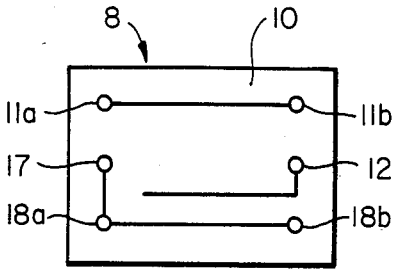
FIGS 1*a* through 1*f* provide schematic diagrams of the method of the invention.
Figure 1B:
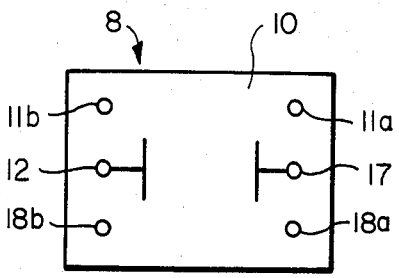

The rigid insulating substrate may be composed of any suitable material or materials eg. alumina, porcelainized metal, glass or pressed fibrous material. The insulating substrate serves the important function of distributing the heat generated by the heating element. This provides a number of advantages, including lengthening the stability and life of the heating element. At the same time, the insulating substrate aids in safety, since it absorbs and distributes mechanical shock and electrical stresses. The substrate preferably has dimensions of 0.1" to 5" length, preferably 0.25" to 1.5" length, 0.01" to 0.1" thickness, preferably 0.02" to 0.06" thickness, and 0.1" to 1.2" width, preferably 0.2" to 1.0" width. For heating relatively broad substrates, however, the module can be wider, for example at least 1.0 inch wide e.g. 1 to 12 inches wide, especially, depending on the substrate, 2" to 6" wide.

The resistive heating component may comprise a conductive polymer, a ceramic or other resistive material which is, or can be formulated as, a composition which is deposited e.g. printed onto the substrate. After the resistive material has been deposited onto the substrate, it can be treated (e.g. heated to evaporate a solvent or to cause a physical and/or chemical change) so that it adheres firmly to the substrate. Preferred resistive materials include Ru $O_2$-based ceramics.

The temperature-responsive component, if present, preferably comprises a material which has a positive temperature coefficient of resistance. If this component is separate from the heating component, it is preferably also secured to, e.g. deposited on, particularly printed onto, the substrate, on the same side or on the opposite side thereof.

As indicated above, an important feature of the invention is the use of leads, preferably wires, foils or springy clips, to connect the modules to the elongate conductors. The leads should be flexible by comparison with the substrate and preferably have a tension and torsion modulus of elasticity less than $10^8$ psi, especially less than $10^7$ psi. The leads preferably have an aspect ratio greater than 0.5, especially greater than 1.0, where the aspect ratio is defined as length (l)/diameter (d) and length (l) is construed to be that portion between and not attached to the module or elongate conductor and diameter (d) is construed to be an equivalent diameter for the case of non-round leads.

A useful equation may be employed to provide indication of the flexibility of a modular heater of the invention, namely, $$K = -\mathrm{Log}\left[\frac{1}{d}\ \frac{F}{ED^2}\right].$$

K is preferably less than 6, especially less than 4. In this equation, l/d is the aspect ratio of the leads and E is the modulus of elasticity of the elongate conductors (psi);

D is the equivalent diameter of the elongate conductors (psi); and

F is the minimum force required to break the bond (electrical continuity) between the module and the elongate conductor. F is measured in the following way. A sample consisting of one module connected to one elongate conductor is taken. Either a push or pull test is conducted in an Instron machine. The length of the elongate conductor extends 1" on either side of the module length. The module is held stationary in the Instron machine, and one end of the elongate wire is connected to the movable jaws of the machine. The other end of the elongate conductor and the module are connected to a multimeter to monitor the electrical integrity of the connection. The elongate conductor is pulled perpendicular to the module and the force at which the electrical continuity is lost is recorded as the bond force F.

The heater preferably comprises two to twenty modules per linear foot of the heater. The heater advantageously further comprises an insulating jacket which comprises mica tape sandwiched between two layers of glass fibers. The heater preferably is adapted to be connected to a constant voltage source.

Attention is now directed to FIG. 1 which provides a schematic diagram of the method and apparatus of the invention. FIG. 1 is divided into sections a–f to show individual steps in making a self-limiting heater of the invention. In particular, FIGS. 1A and 1B provide top and bottom views respectively of a heater 8 formed on a substrate 10. FIGS. 1A and 1B show a first, second, third and fourth conductive pads (numerals 11*a*, 11*b*, 18*a* and 18*b*) secured to the substrate 10. Here, the conductive pads 11*a* and 11*b* are common, as are the conductive pads 18*a* and 18*b*. Also shown is a conductive pad 17 common to conductive pad 18*a* (and 18*b*) and a conductive pad 17 on the bottom of the substrate 10.

Figure 1C:
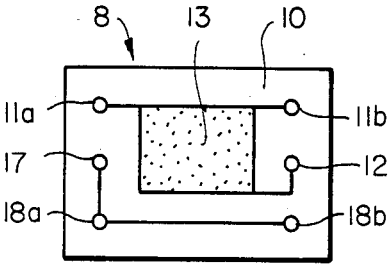
Figure 1D:
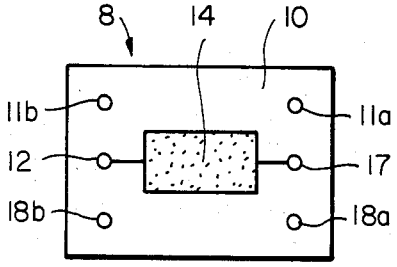

FIG. 1*c* provides a top view of the next step and shows a resistive heating component 13 that has a zero temperature coefficient of resistance which is printed onto the substrate 10 and that makes electrical contact with the conductive pads 11*a*, 11*b* and 12. FIG. 1*d* provides the next bottom view and shows a temperature-responsive component 14 that has a positive temperature coefficient of resistance which is bonded onto the substrate 10 between conductive pads 12 and 17.

Figure 1E:
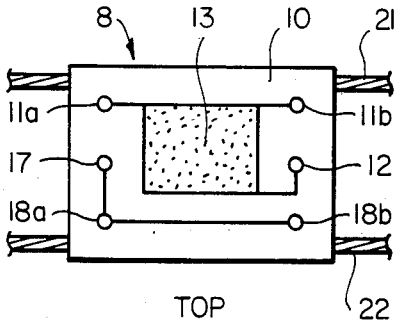
Figure 1F:
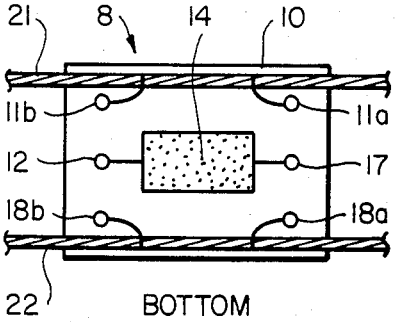

Finally, FIGS. 1*e* and 1*f* show bus bar conductors 21 and 22 which make electrical contact with the conductor pads 11*a*, 11*b* and 18*a*, 18*b*, respectively. Four Monel pins (not shown) may be plasma welded to the bus bar conductors 21 and 22 to make electrical contact with the conductor pads 11*a*, 11*b* and 18*a* and 18*b*.

In operation, the heater 8 is adapted to be connected to a power supply so that current can pass from bus bar conductor 21 through the conductor pads 11*a*, *b*; then through the ZTC component 13 and out through conductor pad 12; and through the PTC component 14 and out through conductor pads 17, 18*a, b* to bus bar conductor 22.

Figure 2:
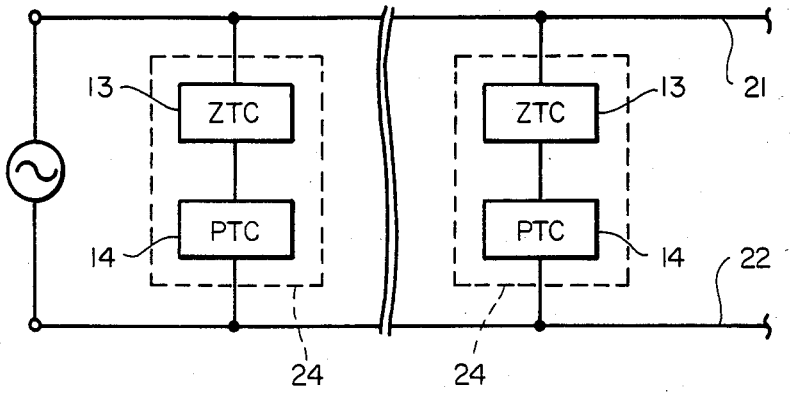
FIG. 2 shows an electrical circuit that corresponds to the FIG. 1 method.

Attention is now directed to FIG. 2 which provides an electrical circuit diagram that corresponds to the heater 8. The ZTC component 13 and PTC component 14 are connected in electrical series and the combined resistance of this module 24 is 10 ohms to 100K ohms. A plurality of such modules 24 is connected in parallel.

Figure 3A:
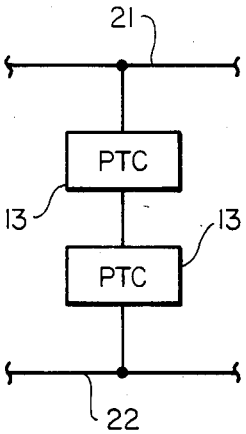
FIGS. 3*a* and *b* illustrate an alternative embodiment of the invention.
Figure 3B:
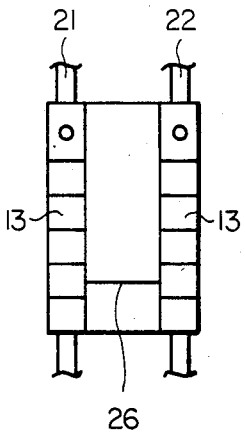

FIGS. 3*a* and 3*b* provide a circuit diagram and view respectively of a different embodiment of the invention. In particular, FIG. 3*a* shows a series connection of PTC components 13 and FIG. 3*b* shows the resultant heater, the series connection being provided along an electrical lead 26. It has been found that the series connection of PTC components 13 optimizes the power requirements of the heater.

EXAMPLE 1

Figure 4:
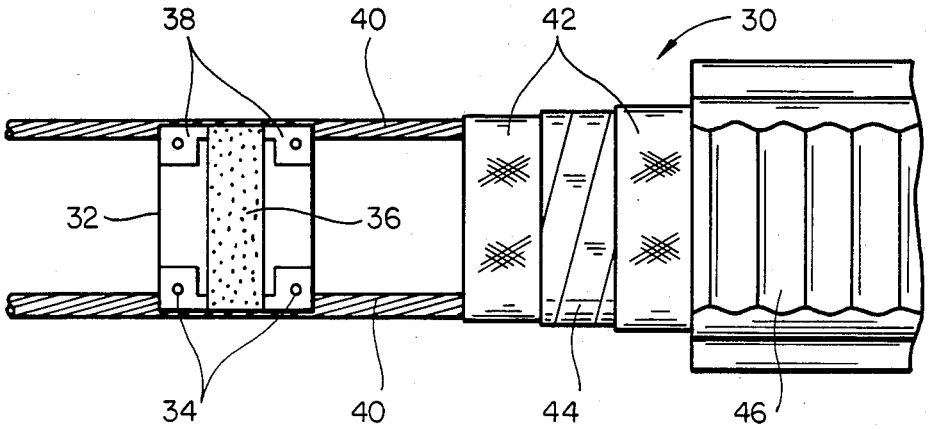
FIGS. 4 and 5 illustrate Examples of the invention.

Attention is now directed to FIG. 4 which illustrates a constant wattage PTC heater 30. An alumina substrate 32 having a 0.375" width, a 0.5" length and 0.040" thickness was provided with 0.032" holes at each corner. The holes were metallised with tungsten and plated with nickel. Four Monel pins (numeral 34), $\frac{1}{8}$" long, were inserted through each hole and brazed to the nickel plating using silver braze. A resistor pattern 36 was screened on the substrate and connected to the pins #4 by way of a conductive thick film 38. The module resistance was 21K ohms. Eight modules were spaced evenly per foot and the Monel pins plasma welded to 14AWG nickel-clad copper stranded wire 40. The insulation, as shown, was glass (42)/mica (44)/glass (42) and the insulated cable was sheathed in a stainless steel sheath 46.

EXAMPLE 2

Figure 5:
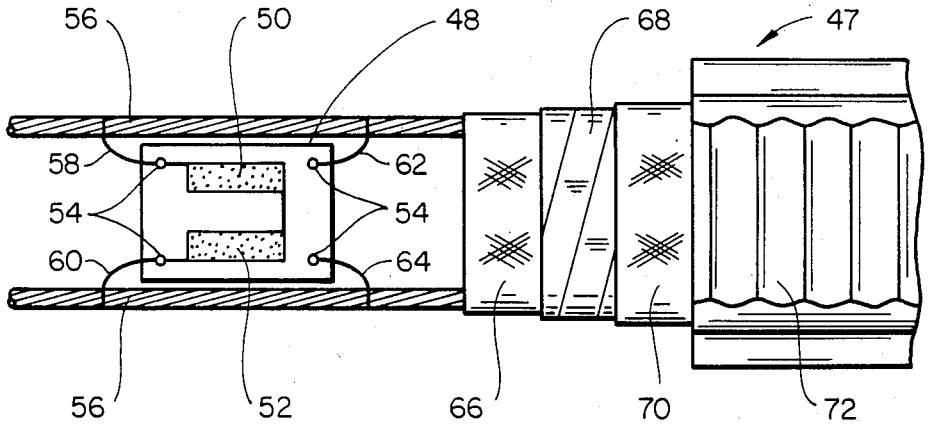

Attention is now directed to FIG. 5 which illustrates a self-regulating PTC heater 47. A substrate 48 was provided and nickel cermet gluing PTC chips 50 and 52 to monel pins (54) and the substrate 48. The PTC chips 50 and 52 were connected in electrical series. Four monel pins were brazed to the substrate; two pins were connected to PTC chips and 14 AWG nickel clad copper bus bars 56 using electrical leads 58 and 60, and two pins only to the substrate 48 and bus bars 56 by way of electrical leads 62 and 64. The heater 47 was enclosed by a primary braid 66, mica tape 68, a secondary braid 70 and an outside sheath 72.

I claim:

1. A heater comprising (1) a pair of flexible elongate parallel conductors which are connectable to a power supply;

(2) a plurality of rigid heating modules connected in parallel with each other between the conductors, each of said heating modules being physically spaced apart from each of the conductors and comprising (a) a rigid insulating substrate; and (b) a resistive heating component which has been deposited on the substrate and which generates heat when the conductors are connected to a suitable power supply; and (3) electrical leads which physically and electrically connect the modules to the elongate conductors, the portions of each of the leads which are not connected either to a module or to a conductor having a tension and torsion modules of elasticity less than $10^8$ psi and an aspect ratio greater than 0.5, where the aspect ratio is defined as length/diameter of the lead and the diameter is an equivalent diameter; wherein the quantity $$-\mathrm{Log}\left[\frac{1}{d}\ \frac{F}{ED^2}\right]$$

is not more than 6, where l=length of lead;

d=equivalent diameter of lead;

E=modulus of elasticity of the elongate parallel conductors;

D=equivalent diameter of the elongate parallel conductors; and

F=minimum force required to break the bond between lead to module.

2. A heater according to claim 1, further comprising a plurality of temperature-responsive components, each of which temperature-responsive components is thermally coupled and electrically connected to one of the heating components and each of which has an electrical property which varies so that, when the heater is connected to a power supply, the heat generated by each of the modules comprising the temperature-responsive components decreases substantially as the temperature of the module approaches an elevated temperature.

3. A heater according to claim 2, wherein the heating component capability of each of the heating components and the temperature-responsive component capability of each of the temperature-responsive components are provided by a single component which combines both capabilities, which single component has a positive temperature coefficient of resistance.

4. A heater according to claim 2, wherein each of the resistive heating components has a substantially zero temperature coefficient of resistance and each of the temperature-responsive components has a positive temperature coefficient of resistance.

5. A heater according to claim 1, wherein each of the heating components has a substantially zero temperature coefficient of resistance.

6. A heater according to claim 2, wherein each of the resistive heating components and each of the temperature-responsive components in each module are connected in electrical series.

7. A heater according to claim 2, wherein each of the modules comprises a temperature-responsive component which is bonded to the substrate of said module.

8. A heater according to claim 1, wherein each module has a resistance at room temperature of 10 ohms to 100K ohms.

9. A heater according to claim 2, wherein each module has a resistance at room temperature of 10 ohms to 100K ohms.

10. A heater according to claim 2, wherein each module comprises at least two separate resistive heating components which are connected in series.

11. A heater according to claim 1, wherein each substrate comprises alumina and has dimensions of 0.1" to 5" length, 0.01" to 0.1" thickness, and 0.1" to 12" width.

12. A heater according to claim 1, wherein each of the resistive heating components is a thick film resistor.

13. A heater according to claim 12, wherein each of the thick film resistors comprises a conductive polymer.

14. A heater according to claim 12, wherein each of the thick film resistors comprises a ceramic.

15. A heater according to claim 1, wherein each of the resistive heating components is printed on a substrate.

16. A heater according to claim 1, comprising two to twenty modules per linear foot of the heater.

17. A heater according to claim 1, which is adapted to be connected to a constant voltage source.

18. A heater according to claim 1, further comprising an insulating jacket which comprises glass-fibers.

19. A heater according to claim 1, wherein each module is connected directly to the conductors by the leads.

20. A heater according to claim 1, wherein the resistive heating components are the sole heating components of the heater.

* * * * *